US012059774B1

(12) United States Patent
Stradling

(10) Patent No.: US 12,059,774 B1
(45) Date of Patent: Aug. 13, 2024

(54) SANDING BLOCK WITH TOOLLESS BELT CHANGING SYSTEM

(71) Applicant: Jason L. Stradling, Pleasant Grove, UT (US)

(72) Inventor: Jason L. Stradling, Pleasant Grove, UT (US)

( * ) Notice: Subject to any disclaimer, the term of this patent is extended or adjusted under 35 U.S.C. 154(b) by 508 days.

(21) Appl. No.: 17/389,189

(22) Filed: Jul. 29, 2021

(51) Int. Cl.
*B24D 15/02* (2006.01)

(52) U.S. Cl.
CPC ..... *B24D 15/023* (2013.01)

(58) Field of Classification Search
CPC ..... B24D 15/04; B24D 15/023; B24D 23/06
USPC ..... 451/517, 513, 504, 458, 523
See application file for complete search history.

(56) References Cited

U.S. PATENT DOCUMENTS 2,761,257 A * 9/1956 Mendelsohn ..... B24D 15/023 451/523
3,510,991 A * 5/1970 Bowen ..... B24D 15/023 451/523
5,172,524 A * 12/1992 Poss ..... B24D 15/023 451/514

* cited by examiner

*Primary Examiner* — Abbie E Quann
(74) *Attorney, Agent, or Firm* — BOOTH UDALL FULLER, PLC

(57) ABSTRACT

A sanding block with a base block, an end block, and a locking shaft. The base block has a cavity extending into the base block and a locking shaft aperture extending through the base block. The end block is slidably coupled with the cavity. The locking shaft extends through the locking shaft aperture and has at least one notch that engages with at least one ridge on the end block. The end block is slidable within the cavity between a retracted position and an extended position. When the end block is in the retracted position, the at least one notch is empty and the locking shaft is moveable along the locking shaft aperture. When the end block is in the extended position, each of the at least one ridge is within the at least one notch and the locking shaft is restricted in movement along the locking shaft aperture.

20 Claims, 8 Drawing Sheets

SANDING BLOCK WITH TOOLLESS BELT CHANGING SYSTEM

TECHNICAL FIELD

Aspects of this document relate generally to tools used for sanding, and more specifically to a sanding block with a toolless belt changing system.

BACKGROUND

Sanding blocks are used to provide an easy way to use sandpaper to sand wood. For some sanding blocks, an endless sanding belt is installed around the sanding block. These sanding blocks often have a wedge or shim which keeps the belt tight during sanding. The wedge or shim often easily works loose and, as a separate piece, may become separated from the sanding block and get lost. Other sanding blocks extend to lock the endless sanding belt onto the sanding block. However, these sanding blocks often require a tool to unlock the sanding belt and retract it to replace the endless sanding belt. This extra tool may also become separated from the sanding block and get lost.

SUMMARY

Aspects of this document relate to a sanding block comprising a base block having a cavity extending into the base block and a locking shaft aperture extending through the base block and intersecting with the cavity, wherein the cavity has a bottom, an end block slidably coupled with the base block within the cavity, the end block having a rounded leading surface, a body extending away from the rounded leading surface into the cavity, a transverse groove extending across the body, and a channel extending away from the transverse groove along the body, the channel creating two ridges, each of the two ridges on an opposite side of the channel from the other of the two ridges, at least one spring within the cavity between the bottom of the cavity and the body of the end block, and a locking shaft extending through the locking shaft aperture and having a first shaft retainer coupled to a first end of the locking shaft and a second shaft retainer coupled to a second end of the locking shaft, wherein each of the first shaft retainer and the second shaft retainer has a cross section larger than the locking shaft aperture, the locking shaft further having two notches, each of the two notches sized to receive one of the two ridges, wherein the end block is slidable within the cavity between a retracted position and an extended position, wherein when the end block is in the retracted position, the locking shaft is within the transverse groove and is moveable along the locking shaft aperture, and wherein when the end block is in the extended position, the locking shaft is within the channel, each of the two ridges is within a respective notch of the two notches, and the locking shaft is restricted in movement along the locking shaft aperture, and wherein the at least one spring is configured to bias the end block to the extended position.

Particular implementations may comprise one or more of the following features. The at least one spring may be at least two springs. The locking shaft may be configured to hold the end block in the retracted position by moving along the locking shaft aperture to misalign the two notches with the two ridges. The first shaft retainer and the second shaft retainer may be configured to prevent the locking shaft from completely exiting the locking shaft aperture.

Aspects of this document relate to a sanding block comprising a base block having a cavity extending into the base block and a locking shaft aperture extending through the base block and intersecting with the cavity, wherein the cavity has a bottom, an end block slidably coupled with the base block within the cavity, the end block having a leading surface, a body extending away from the leading surface into the cavity, a transverse groove extending across the body, and a channel extending away from the transverse groove along the body, the channel creating two ridges, each of the two ridges on an opposite side of the channel from the other of the two ridges, at least one spring within the cavity between the bottom of the cavity and the body of the end block, and a locking shaft extending through the locking shaft aperture and having two notches, each of the two notches sized to receive one of the two ridges, wherein the end block is slidable within the cavity between a retracted position and an extended position, wherein when the end block is in the retracted position, the two notches are empty and the locking shaft is moveable along the locking shaft aperture, and wherein when the end block is in the extended position, each of the two ridges is within a respective notch of the two notches and the locking shaft is restricted in movement along the locking shaft aperture, and wherein the at least one spring is configured to bias the end block to the extended position.

Particular implementations may comprise one or more of the following features. The leading surface may have a curvilinear shape or a rectilinear shape. The sanding block may further comprise at least one shaft retainer configured to limit movement of the locking shaft through the locking shaft aperture. The at least one shaft retainer may comprise a first shaft retainer coupled to a first end of the locking shaft and a second shaft retainer coupled to a second end of the locking shaft, wherein each of the first shaft retainer and the second shaft retainer has a cross section larger than the locking shaft aperture. The at least one spring may be at least two springs. The locking shaft may be configured to hold the end block in the retracted position by moving along the locking shaft aperture to misalign the two notches with the two ridges.

Aspects of this document relate to a sanding block comprising a base block having a cavity extending into the base block, wherein the cavity has a bottom, an end block slidably coupled with the base block within the cavity, the end block having a leading surface, a body extending away from the leading surface into the cavity, and at least one ridge extending along the body, and a locking shaft extending through the base block and having at least one notch, each of the at least one notch sized to receive the at least one ridge, wherein the end block is slidable within the cavity between a retracted position and an extended position, wherein when the end block is in the retracted position, the at least one notch is empty and the locking shaft is moveable with respect to the base block, and wherein when the end block is in the extended position, the at least one ridge is within the at least one notch and the locking shaft is restricted in movement with respect to the base block.

Particular implementations may comprise one or more of the following features. The end block may be biased to the extended position. The sanding block may further comprise at least one spring within the cavity between the bottom of the cavity and the body of the end block. The at least one spring may be at least two springs. The base block may further have a locking shaft aperture extending through the base block and intersecting with the cavity, wherein the locking shaft extends through the locking shaft aperture. The locking shaft may be configured to hold the end block in the retracted position by moving along the locking shaft aperture to misalign the at least one notch with the at least one ridge. The sanding block may further comprise at least one shaft retainer configured to limit movement of the locking shaft through the locking shaft aperture. The at least one shaft retainer may comprise a first shaft retainer coupled to a first end of the locking shaft and a second shaft retainer coupled to a second end of the locking shaft. Each of the first shaft retainer and the second shaft retainer may have a cross section larger than the locking shaft aperture. The leading surface may have a curvilinear shape or a rectilinear shape.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred implementations, but in addition, include any and all structures, materials or acts that perform the claimed function as described in alternative implementations or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
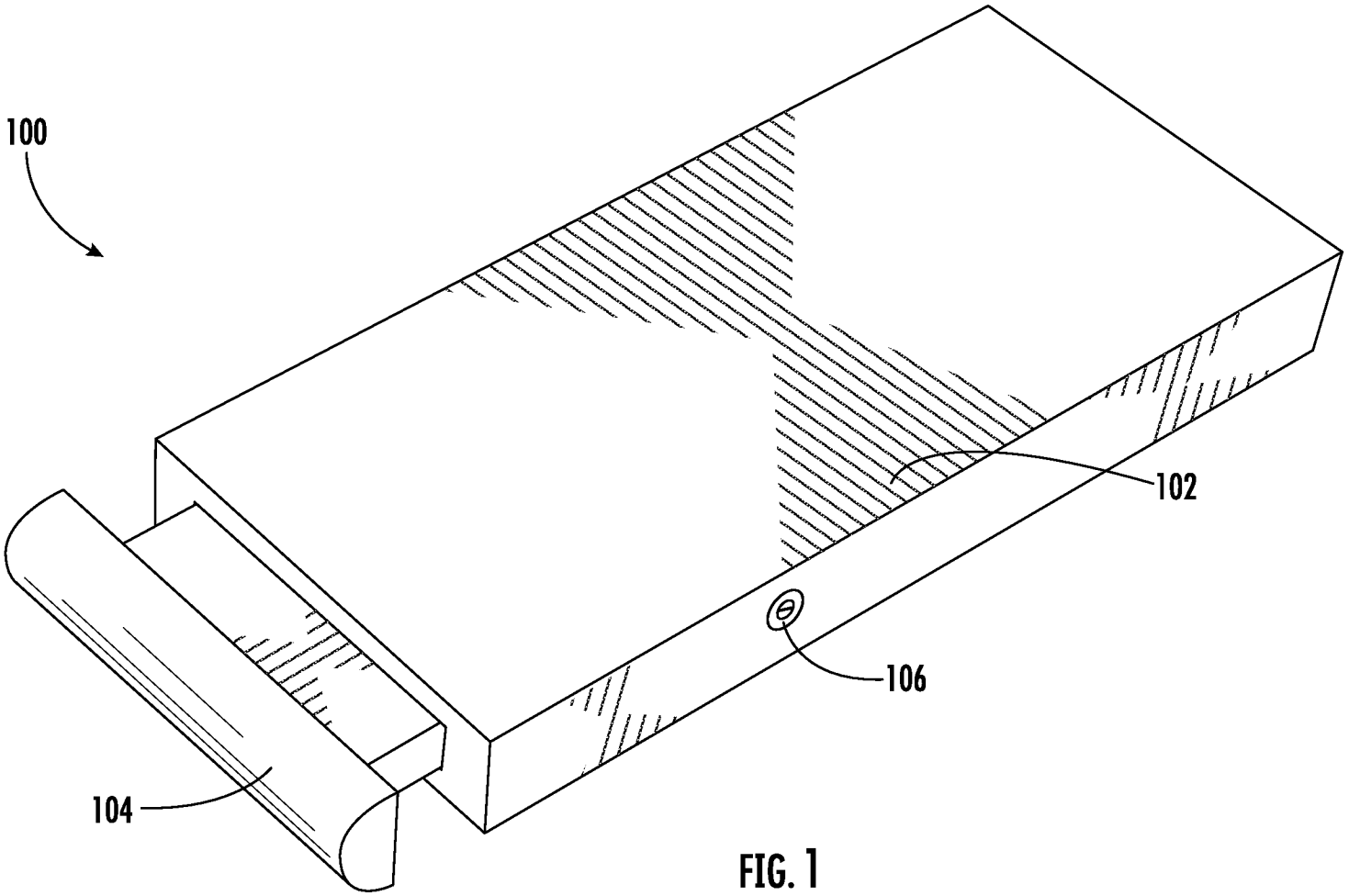
FIG. 1 is a perspective view of a sanding block with a toolless belt changing system.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects, and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure is related to a sanding block 100. The sanding block 100 is configured to have an extended position and a retracted position. When the sanding block 100 has an endless sanding belt installed and is in the extended position, the sanding belt is secured onto the sanding block 100. On the other hand, when the sanding block 100 has an endless sanding belt installed and is in the retracted position, the sanding belt can be easily removed from the sanding block 100.

Figure 2:
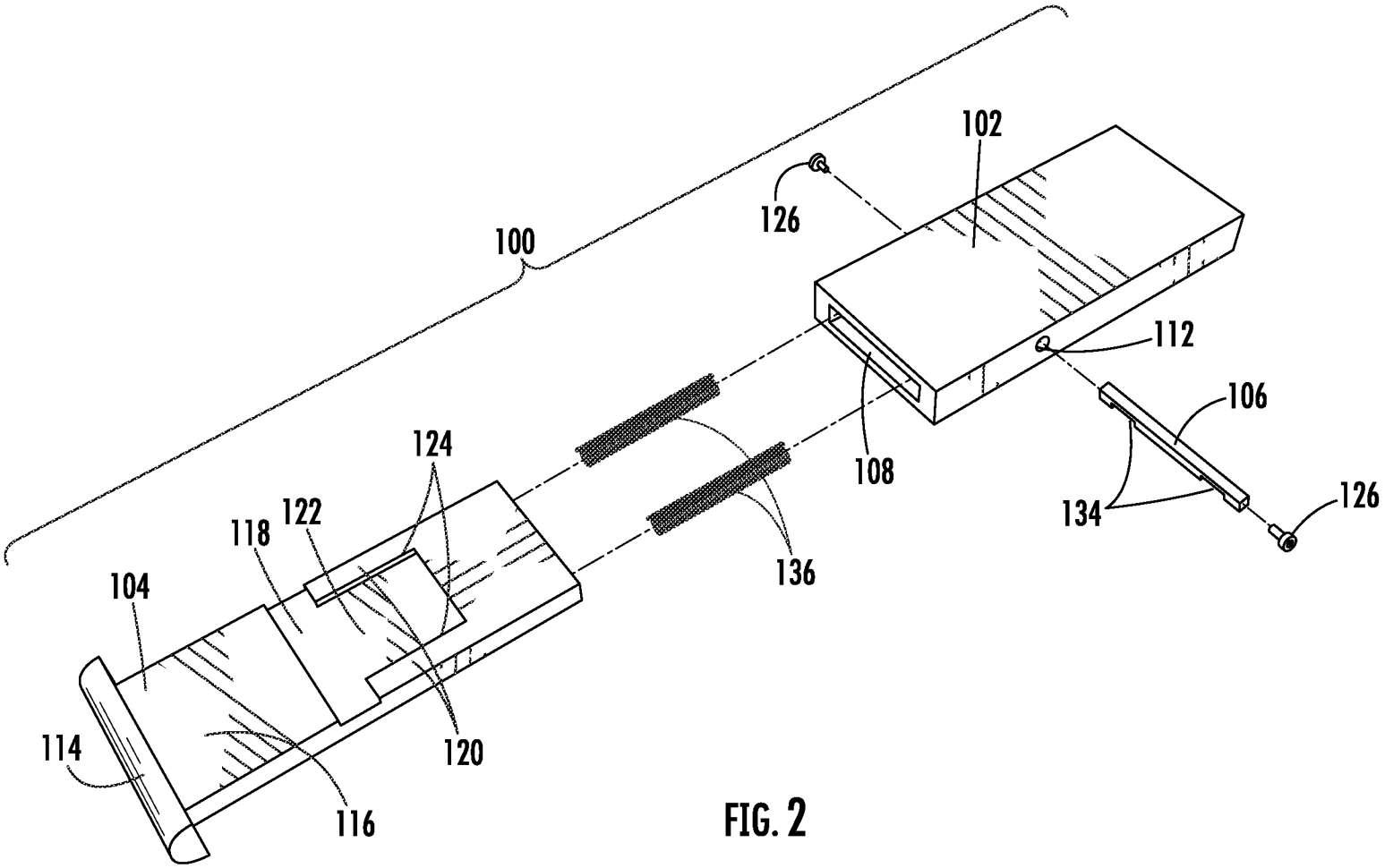
FIG. 2 is an exploded view of the sanding block shown in FIG. 1.
Figure 3:
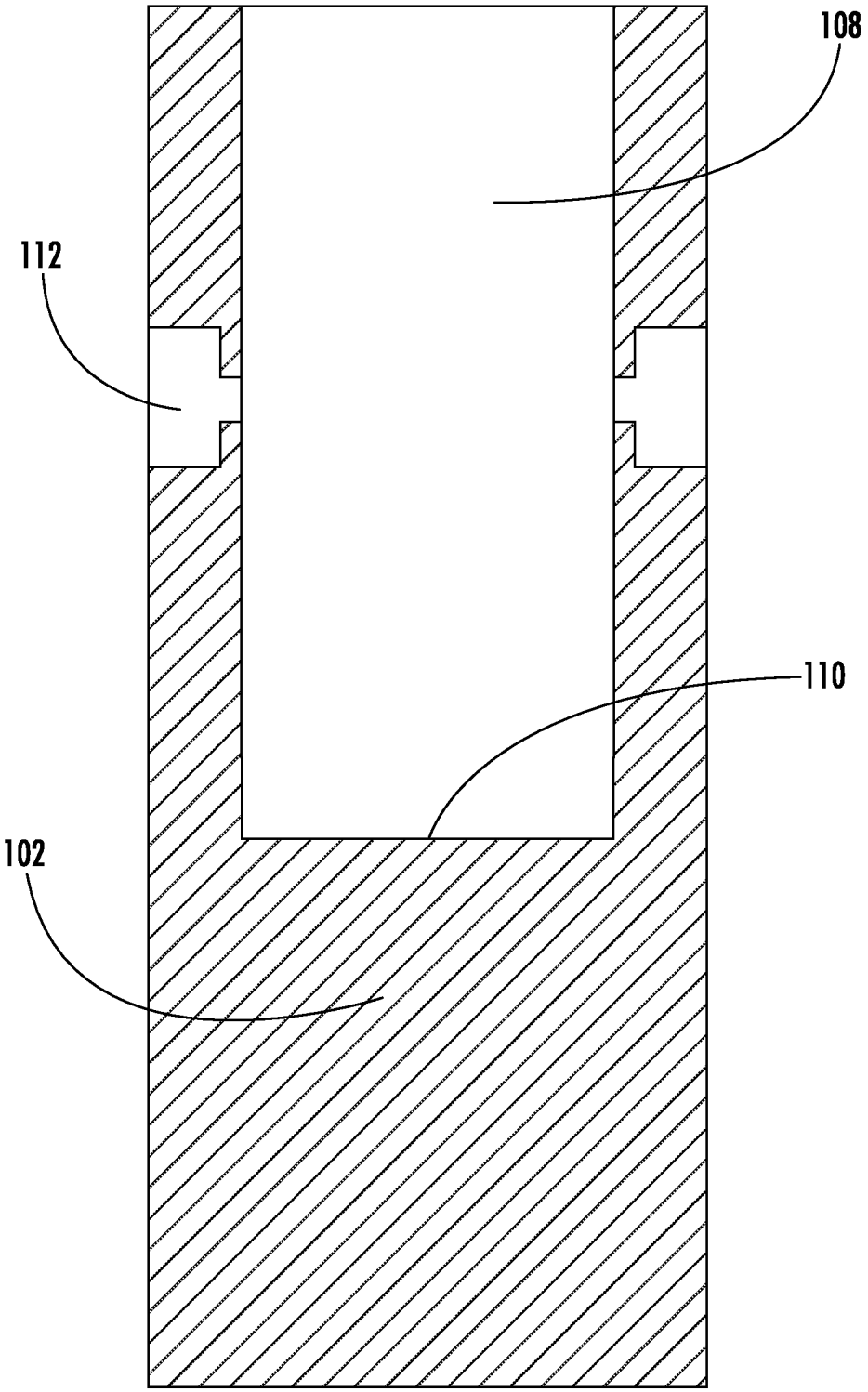
FIG. 3 is a cross section view of the base block of the sanding block shown in FIG. 1.

The sanding block 100 comprises a base block 102, an end block 104, and a locking shaft 106, as shown in FIGS. 1-2. The base block 102 may have a cavity 108 extending into the base block 102. The cavity 108 has a bottom 110 (see FIG. 3). The base block 102 may also have a locking shaft aperture 112 which extends through the base block 102. In some implementations, the locking shaft aperture 112 intersects with the cavity 108, as shown in FIG. 3. Returning to FIGS. 1-2, the end block 104 is slidably coupled with the base block 102. In some implementations, the end block 104 inserts into the cavity 108 and thus telescopes into and is slidably coupled with the base block 102. The end block 104 may have a leading surface 114 and a body 116 extending away from the leading surface 114. The leading surface 114 may be rounded or may be some other shape. For example, in particular implementations, the leading surface 114 has a curvilinear shape and is thus rounded, curved or some other curvilinear shape. In other implementations, the leading surface 114 has a rectilinear shape and is thus squared, tapered, angled, or some other rectilinear shape. When the end block 104 is coupled with the base block 102, the body 116 may extend into the cavity 108. The end block 104 may also have a transverse groove 118 extending across the body 116, and at least one ridge 120 extending along the body 116 away from the transverse groove 118. The at least one ridge 120 may be two ridges 120 and may be formed by a channel 122. For example, in implementations in which the channel 122 extends along the body 116 down a middle of the body 116, the channel 122 creates the two ridges 120, where each of the two ridges 120 is on an opposite side 124 of the channel 122 from the other of the two ridges 120, as shown in FIG. 2. In other implementations, the channel 122 may extend along the body 116 down a side of the body 116, thus creating only one ridge 120. Alternatively, in some implementations, there is no channel 122 and the at least one ridge 120 may extend along a center of the body 116 away from the transverse groove 118. Other configurations that allow the locking shaft 106 to engage with the body 116 of the end block 104 will be obvious to those of skill in the art and are considered equivalent.

Figure 4:
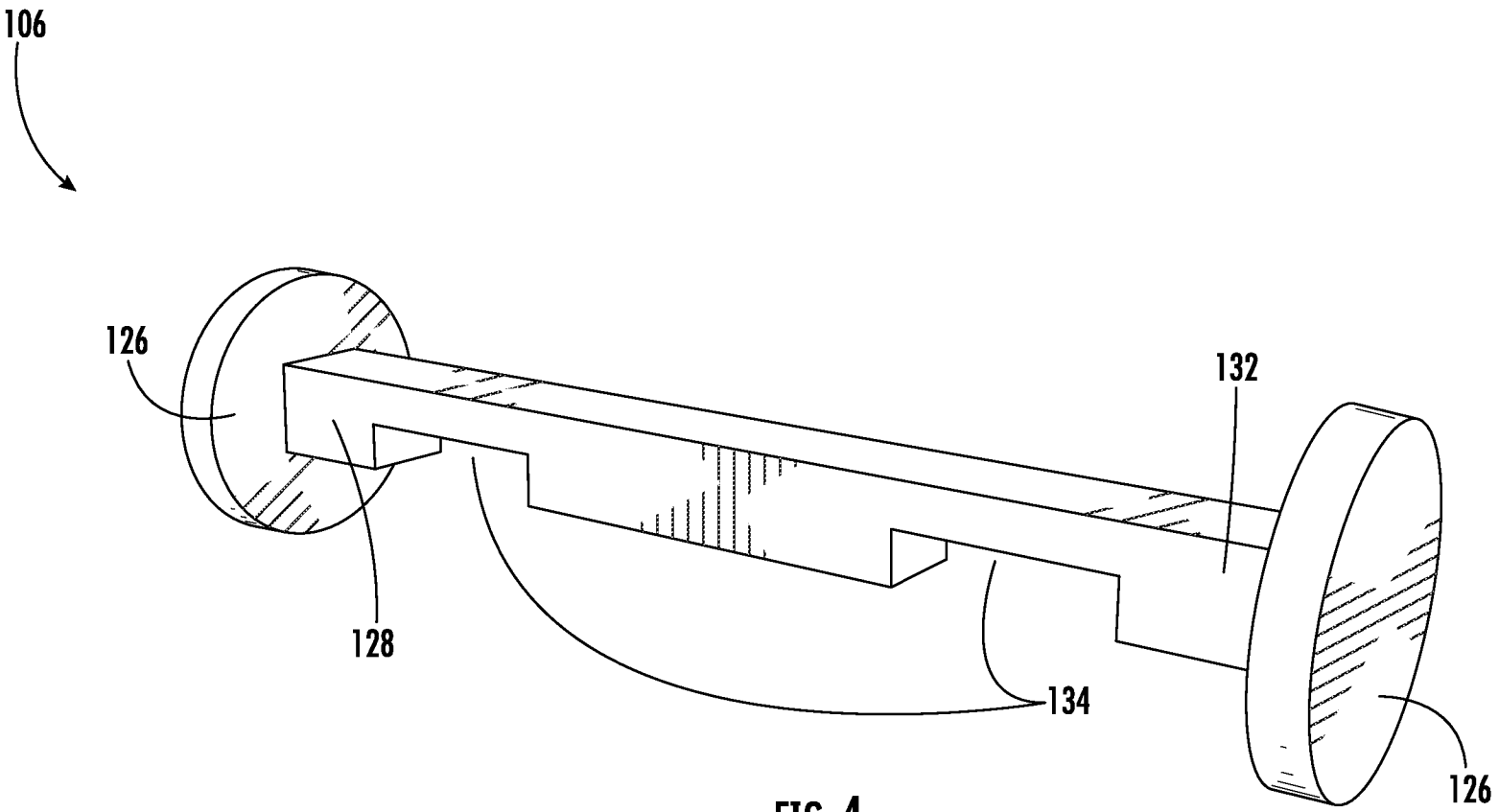
FIG. 4 is a perspective view of a locking shaft of the sanding block shown in FIG. 1.

The locking shaft 106 is configured to extend through the locking shaft aperture 112. As shown in FIG. 4, the locking shaft 106 may have at least one shaft retainer 126 configured to limit movement of the locking shaft 106 through the locking shaft aperture 112. The at least one shaft retainer 126 may be a fastener such as a bolt or a screw. The at least one shaft retainer 126 may include a first shaft retainer 126 coupled to a first end 128 of the locking shaft 106 and a second shaft retainer 126 coupled to a second end 132 of the locking shaft 106. The at least one shaft retainer 126 may have a cross section larger than the locking shaft aperture 112. Thus, when the locking shaft 106 extends through the locking shaft aperture 112 and the first shaft retainer 126 and the second shaft retainer 126 are coupled to the locking shaft 106 on either end, the first shaft retainer 126 and the second shaft retainer 126 may be configured to prevent the locking shaft 106 from completely exiting the locking shaft aperture 112. Additionally, the locking shaft 106 can be moved on either side of the sanding block 100 because a shaft retainer 126 is exposed on either side of the sanding block 100. The locking shaft 106 may be inserted through the locking shaft aperture 112 when the end block 104 is disposed within the cavity 108 by aligning the locking shaft aperture 112 with the transverse groove 118.

The locking shaft 106 may also have at least one notch 134 sized to receive the at least one ridge 120 of the end block 104. This allows the end block 104 to slide within the cavity 108 after the locking shaft 106 has been installed within the locking shaft aperture 112. In implementations with two ridges 120, the locking shaft 106 may have two notches 134, where each of the two notches 134 is sized to received one of the two ridges 120. The sanding block 100 may also comprise at least one spring 136. The at least one spring 136 may be configured to bias the end block 104 to the extended position and may be located within the cavity 108 between the bottom 110 of the cavity 108 and the body 116 of the end block 104. The at least one spring 136 may be positioned in another location as well. Additionally, the at least one spring 136 may be two springs 136.

Figure 5:
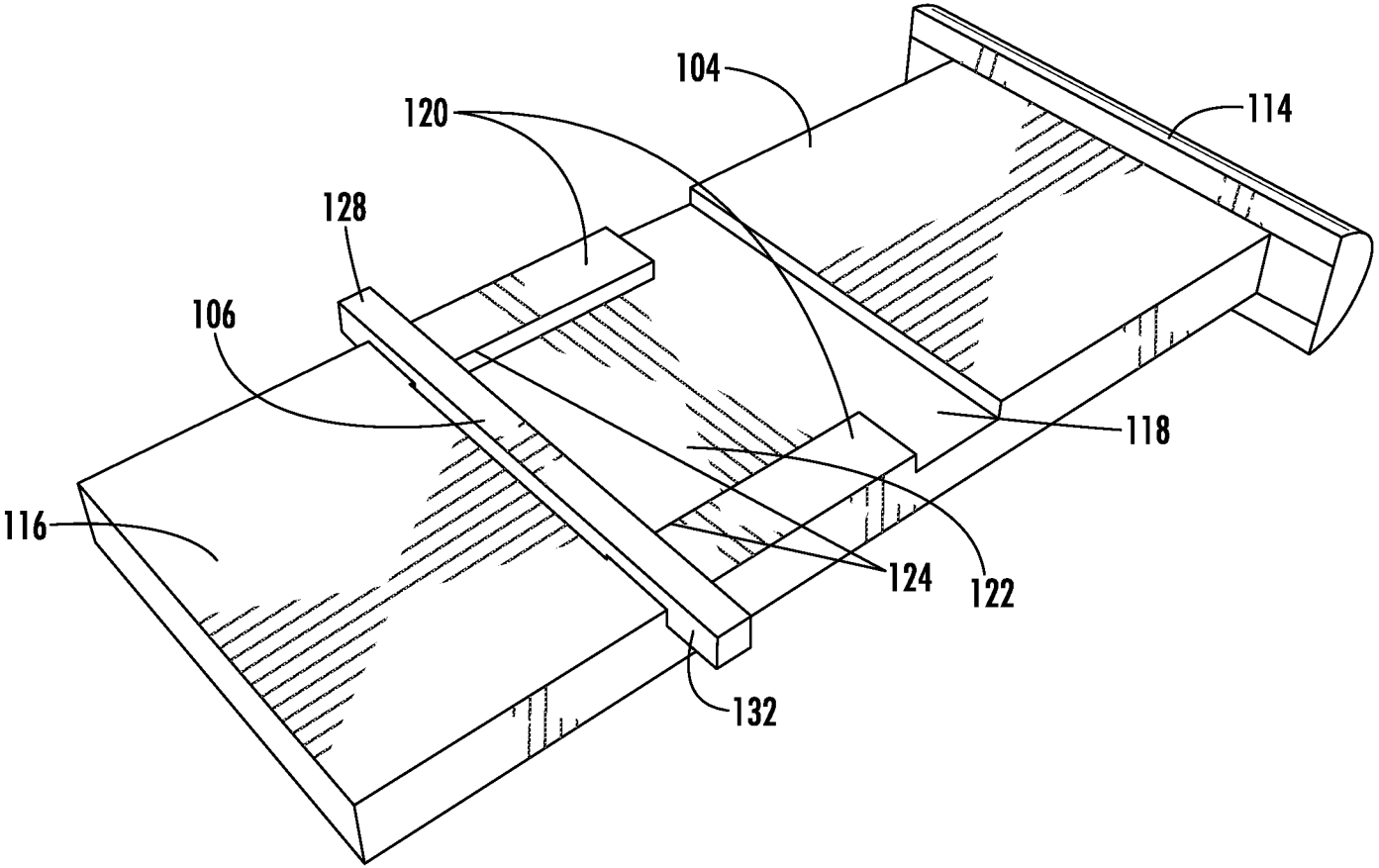
FIG. 5 is a perspective view of the sanding block shown in FIG. 1 with the base block removed and the end block in the extended position.
Figure 6:
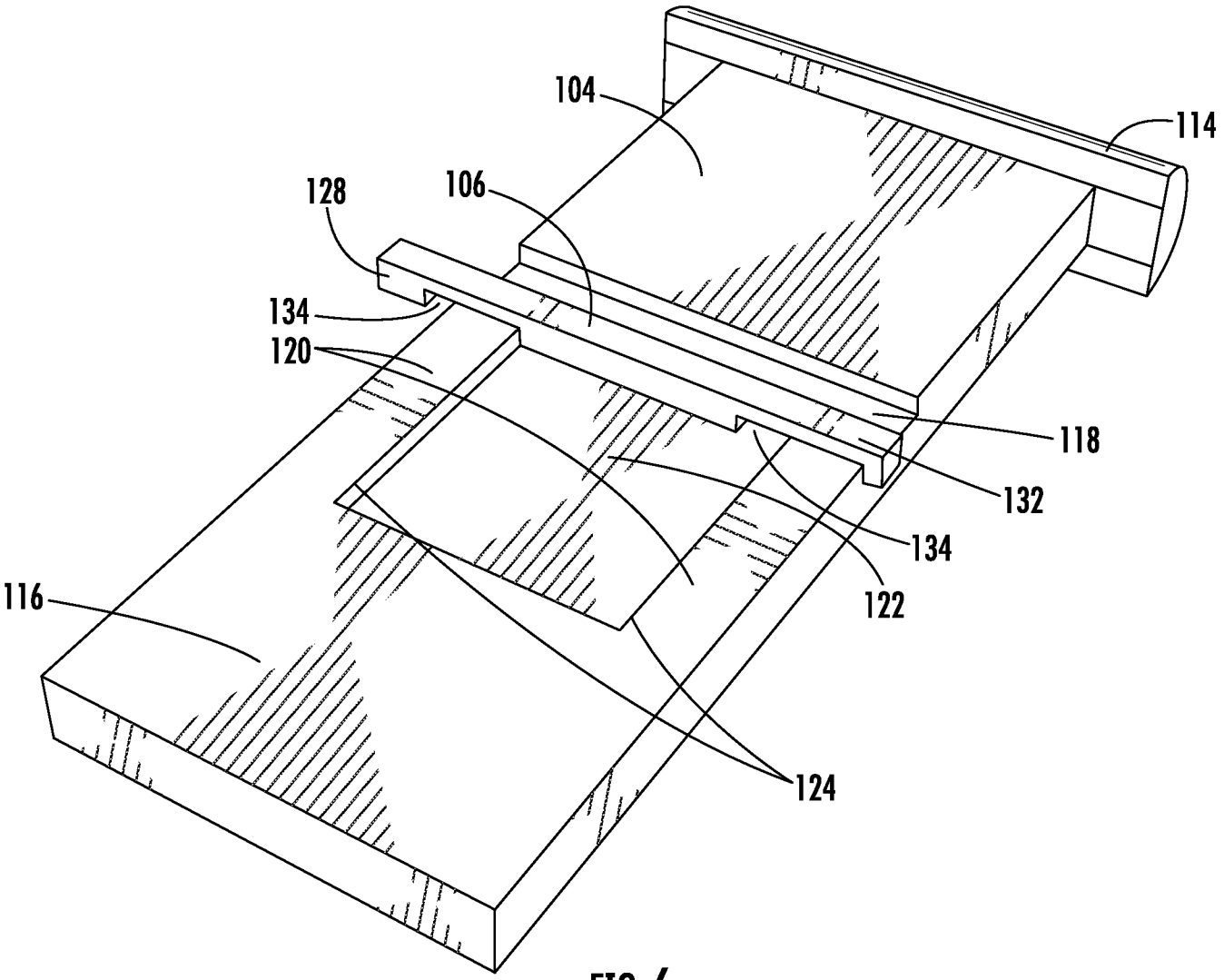
FIG. 6 is a perspective view of the sanding block shown in FIG. 1 with the base block removed, the end block in the retracted position, and the locking shaft positioned to hold the end block in the retracted position.
Figure 7:
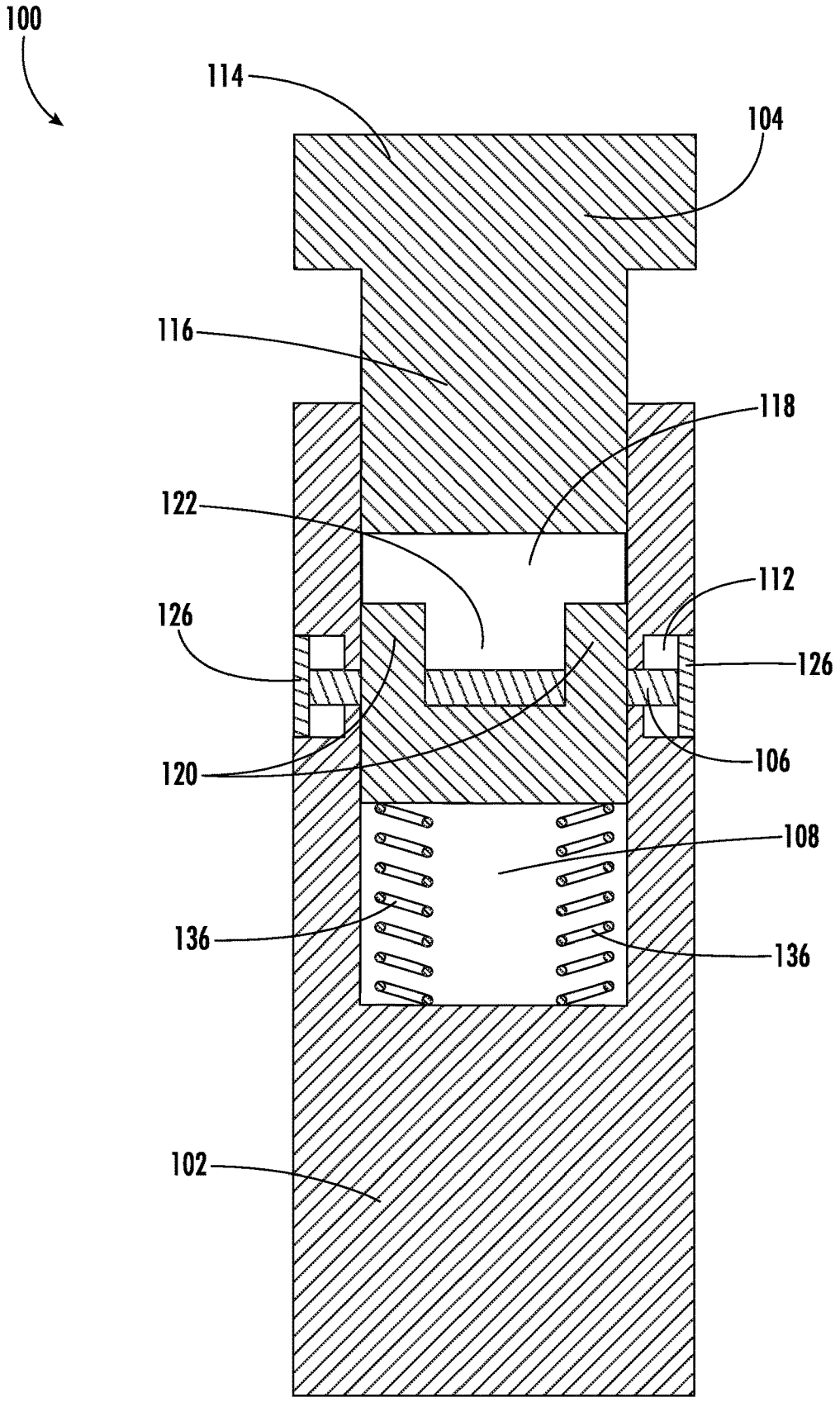
FIG. 7 is a cross section view of the sanding block shown in FIG. 1 with the end block in the extended position.
Figure 8:
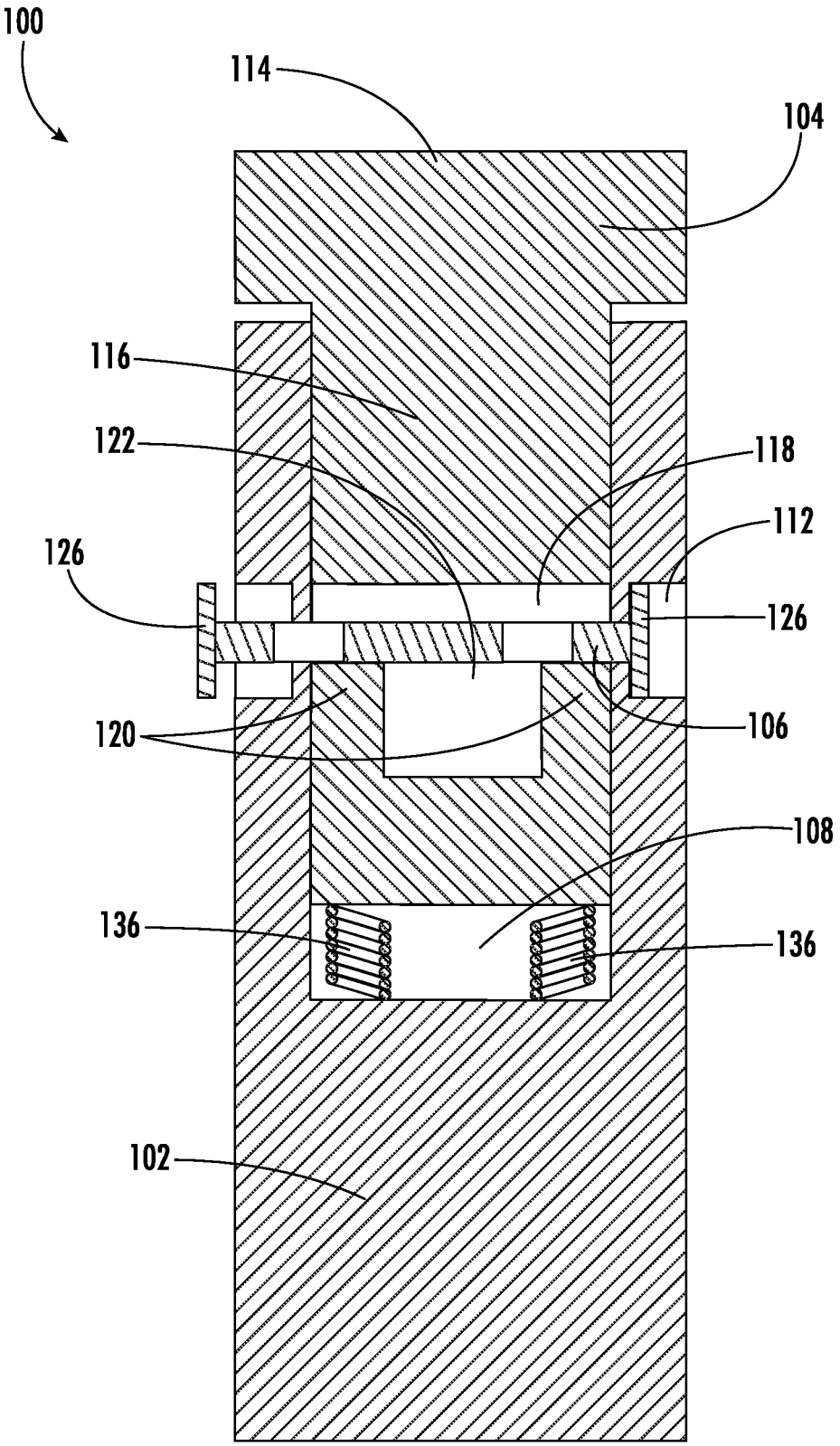
FIG. 8 is a cross section view of the sanding block shown in FIG. 1 with the end block in the retracted position and the locking shaft positioned to hold the end block in the retracted position.

Turning to FIGS. 5-8, the end block 104 is slidable within the cavity 108 between the retracted position and the extended position. When the end block 104 is in the extended position, as shown in FIGS. 5 and 7, each of the at least one ridge 120 is within the respective notch 134 of the at least one notch 134. Thus, the locking shaft 106 is restricted in movement along the locking shaft aperture 112 when the end block 104 is in the extended position. When the end block 104 is in the retracted position, as shown in FIGS. 6 and 8, the at least one notch 134 is empty and the locking shaft 106 is moveable along the locking shaft aperture 112 and the transverse groove 118.

The locking shaft 106 allows the user of the sanding block 100 to lock the sanding block 100 in the retracted position to facilitate changing the sanding belt on the sanding block 100. When the sanding block 100 is in the retracted position, the user may move the locking shaft 106 along the locking shaft aperture 112 to misalign the at least one notch 134 with the at least one ridge 120, as shown in FIGS. 6 and 8. This misalignment prevents the end block 104 from sliding within the cavity 108. The locking shaft 106 thus holds the end block 104 in the retracted position and allows the user to change the sanding belt without having to hold the sanding block 100 in the retracted position. Because the at least one shaft retainer 126 limits movement of the locking shaft 106 within the locking shaft aperture 112, the locking shaft 106 does not completely exit the locking shaft aperture 112 and cannot get lost. Once the sanding belt has been changed, the user may align the at least one notch 134 with the at least one ridge 120, allowing the end block 104 to slide within the cavity 108. In implementations with at least one spring 136, the end block 104 is then biased to move to the extended position, as shown in FIGS. 5 and 7.

Another benefit of the locking shaft 106 is that, when the locking shaft 106 is inserted into the locking shaft aperture 112 and the transverse groove 118, the locking shaft 106 interferes with the separation of the end block 104 from the base block 102 because the bottom 110 of the cavity 108 comes into contact with the locking shaft 106. Thus, the user does not need to worry about the multiple pieces separating and getting lost.

The sanding block 100 may be manufactured from any suitable material, including wood, metal, or plastic. In a particular implementation, the sanding block 100 is formed of a plastic having high stiffness, low friction, and/or dimensional stability. For example, the sanding block 100 may be formed of Polyoxymethylene, sometimes referred to as Delrin plastic. In some implementations, portions of the sanding block 100 may be made hollow to reduce the required material and the weight of the sanding block 100. Additionally, the sanding block 100 may be made using injection molding techniques as known in the art.

It will be understood that implementations of a sanding block are not limited to the specific assemblies, devices and components disclosed in this document, as virtually any assemblies, devices and components consistent with the intended operation of a sanding block may be used. Accordingly, for example, although particular sanding blocks, and other assemblies, devices and components are disclosed, such may include any shape, size, style, type, model, version, class, measurement, concentration, material, weight, quantity, and/or the like consistent with the intended operation of sanding blocks. Implementations are not limited to uses of any specific assemblies, devices and components; provided that the assemblies, devices and components selected are consistent with the intended operation of a sanding block.

Accordingly, the components defining any sanding block may be formed of any of many different types of materials or combinations thereof that can readily be formed into shaped objects provided that the materials selected are consistent with the intended operation of a sanding block. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various sanding blocks may be manufactured using conventional procedures as added to and improved upon through the procedures described here. Some components defining a sanding block may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling sanding blocks are not limited to the specific order of steps as disclosed in this document. Any steps or sequence of steps of the assembly of a sanding block indicated herein are given as examples of possible steps or sequence of steps and not as limitations, since various assembly processes and sequences of steps may be used to assemble sanding blocks.

The implementations of a sanding block described are by way of example or explanation and not by way of limitation. Rather, any description relating to the foregoing is for the exemplary purposes of this disclosure, and implementations may also be used with similar results for a variety of other applications employing a sanding block.

What is claimed is:

1. A sanding block, comprising:

a base block having a cavity extending into the base block and a locking shaft aperture extending through the base block and intersecting with the cavity, wherein the cavity has a bottom;

an end block slidably coupled with the base block within the cavity, the end block having a rounded leading surface, a body extending away from the rounded leading surface into the cavity, a transverse groove extending across the body, and a channel extending away from the transverse groove along the body, the channel creating two ridges, each of the two ridges on an opposite side of the channel from the other of the two ridges;

at least one spring within the cavity between the bottom of the cavity and the body of the end block; and a locking shaft extending through the locking shaft aperture and having a first shaft retainer coupled to a first end of the locking shaft and a second shaft retainer coupled to a second end of the locking shaft, wherein each of the first shaft retainer and the second shaft retainer has a cross section larger than the locking shaft aperture, the locking shaft further having two notches, each of the two notches sized to receive one of the two ridges;

wherein the end block is slidable within the cavity between a retracted position and an extended position, wherein when the end block is in the retracted position, the locking shaft is within the transverse groove and is moveable along the locking shaft aperture, and wherein when the end block is in the extended position, the locking shaft is within the channel, each of the two ridges is within a respective notch of the two notches, and the locking shaft is restricted in movement along the locking shaft aperture; and wherein the at least one spring is configured to bias the end block to the extended position.

2. The sanding block of claim 1, wherein the at least one spring is at least two springs.

3. The sanding block of claim 1, wherein the locking shaft is configured to hold the end block in the retracted position by moving along the locking shaft aperture to misalign the two notches with the two ridges.

4. The sanding block of claim 1, wherein the first shaft retainer and the second shaft retainer are configured to prevent the locking shaft from completely exiting the locking shaft aperture.

5. A sanding block, comprising:

a base block having a cavity extending into the base block and a locking shaft aperture extending through the base block and intersecting with the cavity, wherein the cavity has a bottom;

an end block slidably coupled with the base block within the cavity, the end block having a leading surface, a body extending away from the leading surface into the cavity, a transverse groove extending across the body, and a channel extending away from the transverse groove along the body, the channel creating two ridges, each of the two ridges on an opposite side of the channel from the other of the two ridges;

at least one spring within the cavity between the bottom of the cavity and the body of the end block; and a locking shaft extending through the locking shaft aperture and having two notches, each of the two notches sized to receive one of the two ridges;

wherein the end block is slidable within the cavity between a retracted position and an extended position, wherein when the end block is in the retracted position, the two notches are empty and the locking shaft is moveable along the locking shaft aperture, and wherein when the end block is in the extended position, each of the two ridges is within a respective notch of the two notches and the locking shaft is restricted in movement along the locking shaft aperture; and wherein the at least one spring is configured to bias the end block to the extended position.

6. The sanding block of claim 5, wherein the leading surface has a curvilinear shape or a rectilinear shape.

7. The sanding block of claim 5, further comprising at least one shaft retainer configured to limit movement of the locking shaft through the locking shaft aperture.

8. The sanding block of claim 7, wherein the at least one shaft retainer comprises a first shaft retainer coupled to a first end of the locking shaft and a second shaft retainer coupled to a second end of the locking shaft, wherein each of the first shaft retainer and the second shaft retainer has a cross section larger than the locking shaft aperture.

9. The sanding block of claim 5, wherein the at least one spring is at least two springs.

10. The sanding block of claim 5, wherein the locking shaft is configured to hold the end block in the retracted position by moving along the locking shaft aperture to misalign the two notches with the two ridges.

11. A sanding block, comprising:

a base block having a cavity extending into the base block, wherein the cavity has a bottom;

an end block slidably coupled with the base block within the cavity, the end block having a leading surface, a body extending away from the leading surface into the cavity, and at least one ridge extending along the body; and a locking shaft extending through the base block and having at least one notch, each of the at least one notch sized to receive the at least one ridge;

wherein the end block is slidable within the cavity between a retracted position and an extended position, wherein when the end block is in the retracted position, the at least one notch is empty and the locking shaft is moveable with respect to the base block, and wherein when the end block is in the extended position, the at least one ridge is within the at least one notch and the locking shaft is restricted in movement with respect to the base block.

12. The sanding block of claim 11, wherein the end block is biased to the extended position.

13. The sanding block of claim 11, further comprising at least one spring within the cavity between the bottom of the cavity and the body of the end block.

14. The sanding block of claim 13, wherein the at least one spring is at least two springs.

15. The sanding block of claim 11, the base block further having a locking shaft aperture extending through the base block and intersecting with the cavity, wherein the locking shaft extends through the locking shaft aperture.

16. The sanding block of claim 15, wherein the locking shaft is configured to hold the end block in the retracted position by moving along the locking shaft aperture to misalign the at least one notch with the at least one ridge.

17. The sanding block of claim 15, further comprising at least one shaft retainer configured to limit movement of the locking shaft through the locking shaft aperture.

18. The sanding block of claim 17, wherein the at least one shaft retainer comprises a first shaft retainer coupled to a first end of the locking shaft and a second shaft retainer coupled to a second end of the locking shaft.

19. The sounding block of claim 18, wherein each of the first shaft retainer and the second shaft retainer has a cross section larger than the locking shaft aperture.

20. The sanding block of claim 11, wherein the leading surface has a curvilinear shape or a rectilinear shape.

* * * * *